US005247768A

United States Patent [19]

Russo

[11] Patent Number: 5,247,768

[45] Date of Patent: Sep. 28, 1993

[54] INFLATABLE STRUCTURE

[76] Inventor: Vincent Russo, 9417 Foster Ave., Brooklyn, N.Y. 11236

[21] Appl. No.: 775,502

[22] Filed: Oct. 15, 1991

[51] Int. Cl.[5] ..... E04B 1/34

[52] U.S. Cl. ..... 52/213; 52/2.17; 52/2.22; 52/2.25

[58] Field of Search ..... 52/2.11, 2.18, 2.22, 52/2.24, 2.25, 2.17, 2.13, 2.19

[56] References Cited

U.S. PATENT DOCUMENTS

| | | | |
|---|---|---|---|
| 3,660,951 | 5/1972 | Cadwell | 52/2.17 X |
| 4,766,918 | 8/1988 | Odekirk | 52/2.19 X |
| 4,959,901 | 10/1990 | Parish | 52/2.18 |
| 5,007,212 | 4/1991 | Fritts et al. | 52/2.18 |

FOREIGN PATENT DOCUMENTS

| | | | |
|---|---|---|---|
| 0700282 | 12/1964 | Canada | 52/2.17 |
| 0755885 | 4/1967 | Canada | 52/2.18 |
| 1074765 | 10/1954 | France | 52/2.18 |
| 2341017 | 9/1977 | France | 52/2.18 |

*Primary Examiner*—Carl D. Friedman
*Assistant Examiner*—Lan M. Mai
*Attorney, Agent, or Firm*—Lawrence M. Nawrocki

[57] ABSTRACT

The tent includes an inflatable frame which, when it is not inflated, is flaccid. The frame is continuous and is defined by a generally-tubular member. The frame includes segments which define a floor-forming portion and a pair of oppositely-facing, wall-forming portions. Means are provided to inflate the frame, when desired, to impart a measure of rigidity thereto. A fabric enclosure is provided to surround the frame. At least one substantially-rigid, elongated member is provided for insertion between frame segments defining the pair of oppositely-facing, wall-forming portions of the frame. Those portions are, thereby, maintained at a desired distance from one another.

6 Claims, 2 Drawing Sheets

INFLATABLE STRUCTURE

TECHNICAL FIELD

The present invention deals broadly with enclosure structure technologies. More narrowly, however, the invention deals with small buildings, such as tents, which are erectable and able to be disassembled, as circumstances dictate. The specific focus of the invention is an application for a tent which can be easily and quickly erected and collapsed with only a minimum time and effort investment, but wherein the structure erected is provided with a reliable, defined form.

BACKGROUND OF THE INVENTION

Since time immemorial, mankind has built structures to protect against the elements. In early human history, structures were of the most rudimentary type. As technology has developed, the complexity of buildings has become commensurately greater. Discoveries of new materials have served to enable building structures to more durably function for their intended purposes. The life of a building has been extended far beyond whatever could have been imagined only one hundred years ago.

Buildings serve numerous purposes. Multi-story, skyscraper buildings function to house various commercial functions. Similarly, sprawling warehouse structures can house manufacturing and large-scale storage concerns.

Still, however, the need persists for structures which can be easily and quickly erected and easily and quickly broken down. While the number of applications for such structures is not overwhelming, certainly research and development to be invested in developing a good structure which meets this demand is justified.

Probably the most immediate application requiring such a building is camping. Reliable, durable tents having a high level of water-tight integrity will always be needed.

An additional feature that a tent should have is one wherein it can be easily and quickly erected. Often, campers hike into a location and wish to expend only a minimum amount of energy in "pitching" camp. This may be because of a particularly extended period of hiking into the location at which camp is to be pitched. The party carrying the tent as a portable shelter might be extremely tired as a result of long periods having been spent "on the road". Another factor which bears upon the need to erect the tent quickly and easily is the rapid approach of darkness.

It is also desirable that the tent be able to be quickly and easily broken down. It can, thereby, be readily stowed for transportation to another location. If a long period of time is involved in breaking down the tent and stowing it, an inordinate delay might be incurred in beginning relocation to another point. This could be particularly critical in, for example, a military application.

While it is important that breakdown and erection be able to be accomplished quickly, it is still important that a tent be provided, when it is erected, with structural integrity. This is so since the occupant needs to be able to rely upon the tent not collapsing while it is occupied.

It is to these problems and dictates of the prior art that the present invention is directed. It is an improved structure which not only provides for quick and easy erection and breakdown, but which also affords adequate structural form and integrity when it is erected.

SUMMARY OF THE INVENTION

The present invention is an inflatable structure which includes a frame formed by a continuous, generally-tubular member. When the structure is collapsed, the frame is flaccid. The frame includes various segments which define a floor-forming portion and a pair of oppositely-facing wall-forming portions. The various portions are, however, integrally formed to establish the frame. The frame is an integral, closed system, and means are provided to inflate the frame system to impart a measure of rigidity thereto. A flexible fabric encloses the frame and, when the frame is inflated, it gives form to the fabric enclosure. The invention also includes at least one substantially-rigid, elongated member which can be inserted between the two wall-forming portions to rigidly maintain those portions at a desired distance from one another.

In a preferred embodiment of the invention, the structure can include multiple fittings carried by the frame segments defining the oppositely-facing, wall-forming portions. Corresponding fittings defining a pair are maintained at locations on the wall-forming portion frame segments generally opposite one another. The fittings are designed to receive therein one end of an aluminum tube elongated member, and, once the frame is inflated, such an aluminum tube elongated member can be fitted into corresponding fittings to afford a greater degree of integrity to the structure.

The preferred embodiment also contemplates a construction wherein the flexible fabric is adhered to the frame at desired locations. As a result, when the frame is inflated, the fabric will not bunch, and a desired form will be given thereto.

Further, the preferred embodiment contemplates employment of a bottle of pressurized fluid for use in inflation of the frame. Means are provided for placing the pressurized fluid in the bottle in flow communication with the frame when inflation is desired. Conventional valving means as known in the prior art can be employed for this purpose. It is anticipated that carbon dioxide, maintained under pressure, could be employed for inflation purposes.

Another embodiment of the invention envisions employment of an inflatable mattress which is maintained within the confines of the frame segments defining the floor-forming portion of the frame. Typically, the inflatable mattress would be integrally formed with the frame so that, as the frame were inflated, the mattress would be also. In such an embodiment, the floor of the tent would be integral with the frame.

The present invention is thus an improved tent-structure which addresses many of the problems and dictates of the prior art. More specific features and advantages will become apparent with reference to the DETAILED DESCRIPTION OF THE INVENTION, appended claims, and accompanying drawing figures.

DETAILED DESCRIPTION OF THE INVENTION

Figure 4:
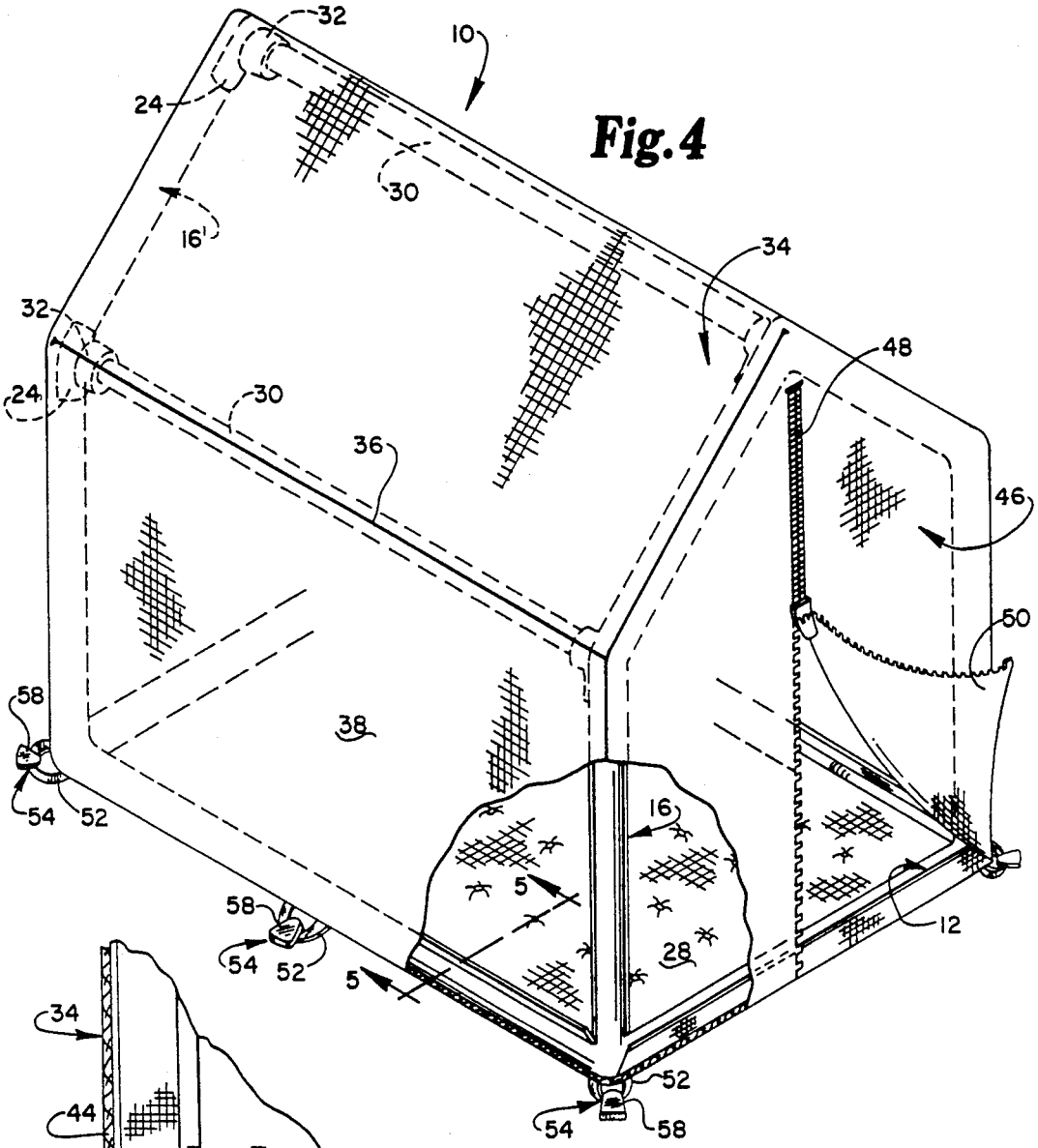
FIG. 4 is a view, similar to that of FIG. 1, illustrating another embodiment of the invention.
Figure 5:
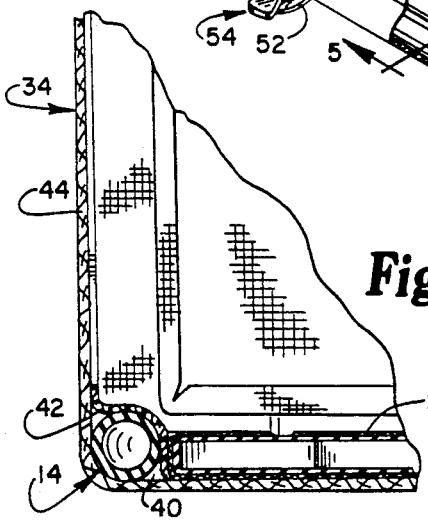
FIG. 5 is a view, similar to that of FIG. 2, illustrating, in section, a portion of the structure illustrated in FIG. 4.

Referring now to the drawings wherein like reference numerals denote like elements throughout the several views, and specifically to FIGS. 4 and 5, a preferred embodiment of the present invention is illustrated. The tent structure 10 includes a unitary frame 12 which comprises a flexible, generally-tubular member. The frame 12 includes various segments, each segment, defining, in combination with other segments, a floor-forming portion of the frame 14, or one of two oppositely-facing, wall-forming portions 16, 16'. The segments are, however, continuous so that, as a fluid (typically, a gas) is injected at a location along one segment, the fluid will be free to pass into, and inflate, all segments so that the frame 12 is given a measure of rigidity.

Figure 1:
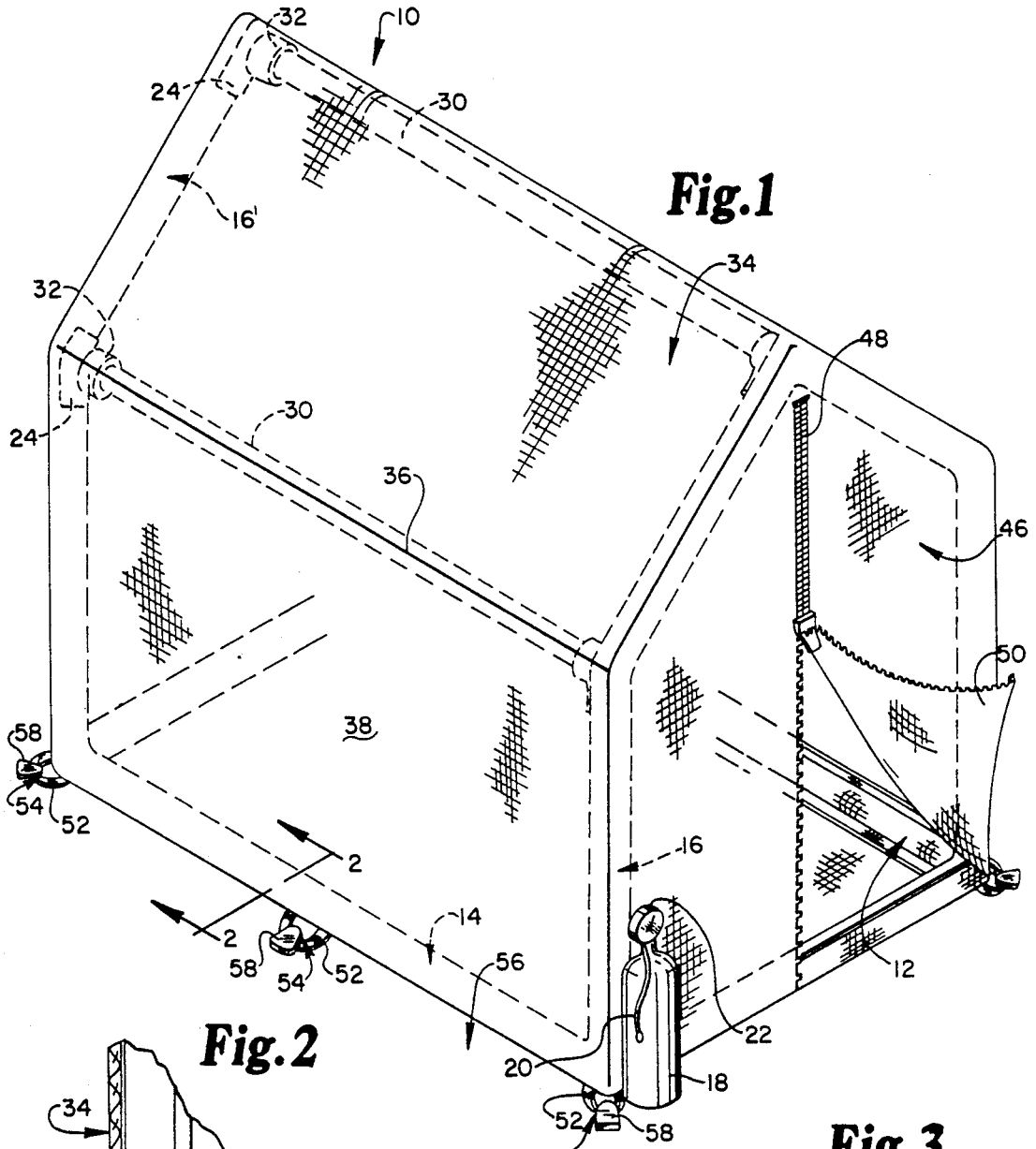
FIG. 1 is a perspective view of one embodiment of a structure in accordance with the present invention.

FIG. 1 illustrates a gas bottle 18 (such as a carbon dioxide bottle) mounted at a location on one of the segments defining the forward wall-forming portion 16. The bottle 18 includes a lanyard 20 to initiate actuation and release of the gas into the frame-forming tubular member. FIG. 1 also shows the bottle 18 as having a gauge 22 so that the pressure of fluid inside the bottle 18 can be easily ascertained.

The bottle 18 would be mounted at the location of a valve through which the fluid could be introduced into the system. Typically, the bottle 18 would be transported independently of the overall tent structure 10 and mated, through appropriate means, to the valve when erection of the tent 10 is desired. In other embodiments, however, the bottle 18 could be permanently or semi-permanently affixed to the valve, or merely temporarily mated to the valve when inflation is desired.

Figure 3:
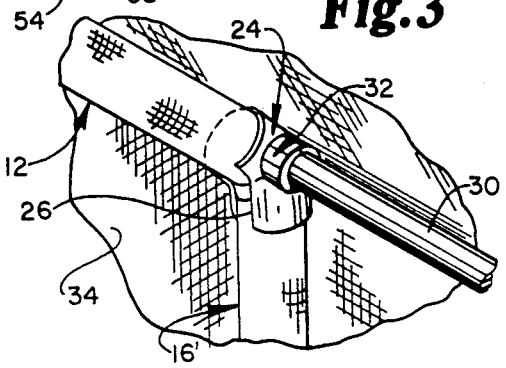
FIG. 3 illustrates the intersection of two frame segments defining one wall-forming portion of the structure mounting a fitting for receipt of one end of a substantially-rigid, elongated member used to give form to the structure.

As seen with reference to FIGS. 1 and 4, the particular embodiment illustrate has a peaked roof. That is, the segments of the frame 12 defining the front and rear wall-forming portions 16, 16' define a pentagonal shape with the two sides extending generally vertically to a certain height and then being angled inwardly to converge at the top of the structure 10. In order to facilitate manufacture of the frame 12 so that this can be accomplished, the intersections of segments can, in fact, be a straight portion of the tubular member with a rigid clamp-like fitting 24 being employed to diverge the various segments at the desired defined angle. This is best illustrated in FIG. 3 which shows the tubular member having been inserted through a slit 26 in the fitting 24 extending along the length thereof, the fitting 24 being in the form of an elbow-joint.

The embodiment of FIG. 4 employs a mattress 28 which is received within the frame segments defining the floor-forming portion 14. The mattress 28 is substantially the same size and shape as the perimeter defined by those segments of the frame 12 so that it is tightly fitted within the floor-forming portion 14 of the frame 12. In fact, in the preferred embodiment, it is intended that the mattress 28 be in fluid communication with the floor-forming portion 14 through one or more ports (not shown) in the various frame 12 segments. As the frame is inflated, therefore, the mattress 28 will also be inflated.

As will be able to be seen then, in view of this disclosure, the tent structure 10 can be such so that air mattresses, cots, or other devices which might insulate an occupant of the tent 10 from the ground can be avoided. Such a structure, therefore, results in both comfort and cost savings.

Figure 2:
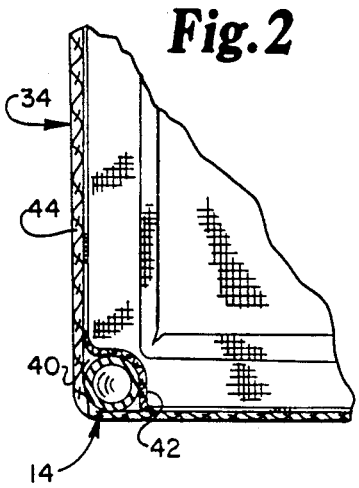
FIG. 2 is an enlarged sectional view taken generally along the line 2—2 of FIG. 1, some portions of the structure being broken away.

As seen in FIGS. 1 and 2, the invention includes at least one substantially-rigid, elongated member 30 which spaces the front wall-forming portion 16 of the frame 12 from the rear wall-forming portion 16'. In fact, FIGS. 1 and 4 illustrate three such members 30. In the absence of such structural supports 30, a very low measure of rigidity would be afforded to the structure 10 when it is inflated. By employing such members 30, however, while the structure is light and easily erectable, it is also provided with sufficient rigidity to give it the necessary form to ensure that sagging will be at a minimum.

These tubular members 30 can be formed of any material which gives a sufficient degree of rigidity. It is, of course, desired that they be light in weight so as not to detract from the transportability of the structure. The preferred embodiment envisions employment of tubular members 30 made of aluminum. Other appropriate materials such as fiberglass could also be used, however.

Mounting of the tubular members 30 is accomplished by providing fittings 32 carried by the appropriate frame segments at which mounting is desired. As has previously been discussed herein, fittings 24 are provided to effect angular divergence of adjacent frame segments of the flexible member defining the frame 12, and the elongated, substantially-rigid member mounting fittings 32 can be integrated with these elbow-forming fittings 24. Again, this is illustrated best in FIG. 3.

The length of a particular rigid structural member 30 would be substantially the same as the ultimate intended distance between the fittings 32 which are intended to receive and mount the rigid elongated members 30. As will be seen hereinafter, a "skin" is applied over the frame, and, by making the rigid members 30 of such lengths, the covering material forming the "skin" can be made taut.

FIGS. 1 and 4 illustrate a flexible fabric 34 which surrounds the frame 12. The fabric enclosure 34 is constructed so that, when the frame 12 is inflated, the enclosure 34 will conform to the frame 12. That is, edges of the various segments of the enclosure 34 will be substantially the same lengths as structural support segments and members which they overlie. For example, an upper edge 36 of one side wall 38 of the fabric enclosure 34 would be substantially the same length as the substantially-rigid, elongated members 30 inserted to space the front wall-forming portion 16 of the frame 12 from the rear wall-forming portion 16' of the frame 12.

The fabric enclosure 34 would be formed of any appropriate material. The particular material adopted, however, should possess all desirable characteristics for a tent. It should be durable, tear-resistant, water-proof, etc.

FIGS. 2 and 5 in particular illustrate the lateral floor-forming segments of the frame 12 as being received within pockets 40 defined by a flap 42 secured to an outer sheathing 44 of the tent enclosure 34. This precludes migration of the frame 12 relative to the enclosure 34. It is intended, therefore, that the inflatable tubular-like frame 12 be secured to the fabric enclosure 34 at appropriate locations, and such securing means can be employed along the full length of the frame 12. It will be understood, however, that any appropriate securing mechanism other than that specifically illustrated and discussed would be appropriate.

FIGS. 1 and 4 show the front panel 46 of the fabric enclosure 34 as having a zipper 48 extending substantially vertically along the center line of the panel 46. Such a zipper 48 enables the definition of at least one door portion 50 of the panel 46 in a manner as is practiced in the prior art. Such a door portion 50 enables an occupant to enter into, and exit from, the interior of the structure 10.

FIGS. 1 and 4 also illustrate a plurality of loops 52 mounted to the fabric enclosure 34 proximate the floor thereof. The loops 52 are shown as being on the outside of the structure 10. These loops 52 enable stakes 54 to secure the overall structure 10 to the ground 56. The stakes 54 illustrated are of a typical construction having a shank portion (not shown) which is pounded into the ground 56, and an upper flange 58 which captures the loop 52 through which the stake 54 is made to extend. The figures illustrate three such stake/loop combinations spaced along each lateral edge of the tent structure 10.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. An inflatable structure, comprising:

(a) an integral frame, flaccid when the structure is in a collapsed configuration, formed by a continuous, generally-tubular member, said frame including segments defining:

(i) a floor-forming portion; and (ii) a pair of oppositely-facing, wall-forming portions;

(iv) means for inflating said frame to impart a measure of rigidity thereto;

(c) a flexible fabric enclosing said frame;

(d) at least one substantially-rigid, elongated member insertable between said wall-forming portions to maintain said wall-forming portions at a desired distance from one another; and (e) fitting means carried by frame segments defining said pair of oppositely-facing, wall-forming portions for receiving opposite ends of said at least one substantially rigid, elongated member, said fitting means including elbow clip means for diverging said frame segments defining said pair of oppositely-facing, wall-forming portions at a desired defined angle.

2. An inflatable structure, comprising:

(a) an integral frame, flaccid when the structure is in a collapsed configuration, formed by a continuous, generally-tubular member, said frame including segments defining:

i) a floor-forming portion; and (ii) a pair of oppositely-facing, wall-forming portions;

(iv) means for inflating said frame to impart a measure of rigidity thereto;

(c) a flexible fabric enclosing said frame;

(d) a plurality of substantially-rigid, elongated members insertable between said wall-forming portion as to maintain said wall-forming portions at a desired distance from one another, each of said substantially rigid, elongated members comprising an aluminum tube; and (e) means carried by frame segments defining said pair of oppositely-facing, wall-forming portions for receiving opposite ends of said plurality of substantially-rigid, elongated members, wherein said receiving means comprises a pair of fittings to receive opposite ends of each substantially-rigid, elongated member, one of each of said pairs of fittings being carried by frame segments defining one of said oppositely-facing, wall-forming portions at a location opposite a corresponding fitting carried by frame segments defining the other of said oppositely-facing, wall-forming portions.

3. A structure in accordance with claim 2 wherein said flexible fabric is adhered to said frame so that, when said frame is inflated, said frame gives a desired form to said fabric.

4. A structure in accordance with claim 2 wherein said inflating means comprises a bottle of pressurized fluid, and further comprising means for placing pressurized fluid in said bottle in flow communication with said generally-tubular member forming said frame.

5. A structure in accordance with claim 2 further comprising an inflatable mattress enclosed within said frame segments defining said floor-forming portion of said frame and being integrally formed therewith, said mattress being in fluid communication with said frame so that, as said frame is inflated, said mattress is inflated also.

6. An inflatable structure, comprising:

(a) an integral frame. flaccid when the structure is in a collapsed configuration, formed by a continuous, generally-tubular member, said frame including segments defining:

(i) a floor-forming portion; and (ii) a pair of oppositely-facing, wall-forming portions;

(iv) means for inflating said frame to impart a measure of rigidity thereto;

(c) a flexible fabric enclosing said frame; and (d) a plurality of substantially-rigid, elongated members insertable between said wall-forming portions to maintain said wall-forming portions at a desired distance from one another, each of said substantially rigid, elongated members comprising an aluminum tube.

* * * * *